US011705030B2

(12) United States Patent
Reed et al.

(10) Patent No.: US 11,705,030 B2
(45) Date of Patent: Jul. 18, 2023

(54) ADAPTABLE AND DEFORMABLE THREE-DIMENSIONAL DISPLAY WITH LIGHTING EMITTING ELEMENTS

(71) Applicant: Toyota Motor Engineering & Manufacturing North America, Inc., Plano, TX (US)

(72) Inventors: Frankie B. Reed, Ypsilanti, MI (US); John C. Rafferty, Dexter, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 17/540,879

(22) Filed: Dec. 2, 2021

(65) Prior Publication Data

US 2023/0177989 A1 Jun. 8, 2023

(51) Int. Cl.
*G09G 3/00* (2006.01)
*G09G 3/32* (2016.01)

(52) U.S. Cl.
CPC ..... *G09G 3/035* (2020.08); *G09G 3/32* (2013.01); *G09G 2320/0626* (2013.01); *G09G 2320/0666* (2013.01); *G09G 2380/10* (2013.01)

(58) Field of Classification Search
CPC .. G09G 3/035; G09G 3/32; G09G 2320/0626; G09G 2320/0666; G09G 2380/10; G09G 3/2003; G06F 3/0234; G06F 3/04886; G06F 3/016; G06F 3/041; G06F 3/0238; B06B 1/0629; G09B 21/003; H10K 77/111; H01H 13/83
See application file for complete search history.

(56) References Cited

U.S. PATENT DOCUMENTS 9,335,830 B2 * 5/2016 Guerin ..... G06F 3/0238
10,444,856 B1 * 10/2019 Wang ..... H01H 13/83
2005/0030292 A1 * 2/2005 Diederiks ..... G09B 21/003 345/173
2006/0238510 A1 * 10/2006 Panotopoulos ..... G06F 3/0238 345/168
2009/0250267 A1 * 10/2009 Heubel ..... G06F 3/04886 178/18.03

(Continued)

FOREIGN PATENT DOCUMENTS

CN 102667671 A 9/2012
CN 110065267 B 3/2021

(Continued)

OTHER PUBLICATIONS

Christie Schweinsberg, "Smart Surfaces Can Simplify Interiors, Improve Safety", WardsAuto UX Converence Online Article, Oct. 3, 2018, 7 pages.

*Primary Examiner* — Richard J Hong
(74) *Attorney, Agent, or Firm* — Jordan IP Law, LLC

(57) ABSTRACT

Methods, apparatuses and systems provide for technology to identify a communication that is to be presented to a user. The technology controls a first plurality of actuators to press a first portion of a light emitting element (LEE) layer against a deformable layer to deform the deformable layer into a shape that represents the communication to be presented to the user, and controls the LEE layer to emit light from the first portion of the LEE layer that is pressed against the deformable layer to illuminate the shape of the deformable layer.

20 Claims, 10 Drawing Sheets

(56) References Cited

U.S. PATENT DOCUMENTS

| | | | | |
|---|---|---|---|---|
| 2009/0315832 | A1* | 12/2009 | Gray | G06F 3/04886 345/169 |
| 2011/0304550 | A1* | 12/2011 | Romera Jolliff | G06F 3/016 715/810 |
| 2012/0242592 | A1* | 9/2012 | Rothkopf | G06F 3/041 345/173 |
| 2014/0071079 | A1* | 3/2014 | Heubel | B06B 1/0629 345/173 |
| 2014/0098075 | A1* | 4/2014 | Kwak | G09G 3/2003 345/204 |
| 2014/0104047 | A1* | 4/2014 | Bolzmacher | G06F 3/041 340/407.2 |
| 2015/0091834 | A1* | 4/2015 | Johnson | G06F 3/04886 345/173 |
| 2017/0068318 | A1* | 3/2017 | McClure | G06F 3/016 |
| 2018/0370364 | A1* | 12/2018 | Vassily | G06F 3/0234 |
| 2020/0210003 | A1* | 7/2020 | Hong | G06F 3/016 |
| 2021/0065590 | A1* | 3/2021 | Huang | H10K 77/111 |

FOREIGN PATENT DOCUMENTS

| | | | |
|---|---|---|---|
| KR | 102080725 | B1 | 2/2020 |
| WO | 2018134004 | A1 | 7/2018 |

* cited by examiner

ADAPTABLE AND DEFORMABLE THREE-DIMENSIONAL DISPLAY WITH LIGHTING EMITTING ELEMENTS

TECHNICAL FIELD

Embodiments generally relate to displaying three-dimensional symbols or messages. Some embodiments provide a display system of a vehicle, that is capable of displaying three-dimensional messages through movement of light-emitting elements (LEEs) and controlled light emission of from the LEEs.

BACKGROUND

A cabin of a vehicle may include numerous displays, dials, buttons and screens. As vehicles increase in complexity and options, the number of displays, dials, buttons and screens may increase thus presenting an unsightly and confusing presentation to occupants of the vehicle. Thus, it may be desirable to enhance the cabin design by reducing a number of the displays, dials, buttons and screens. Doing so has proved to be problematic as reducing the number displays, dials, buttons and screens may reduce functionality and/or result in increased actions of occupants to execute a function.

BRIEF SUMMARY

Some embodiments include a display system for a vehicle. The display system comprises a deformable layer that is configured to deform, a LEE layer, a first plurality of actuators that are configured to press the LEE layer against the deformable layer to deform the deformable layer, and a message controller that includes logic. The logic controls the first plurality of actuators to press a first portion of the LEE layer against the deformable layer to deform the deformable layer into a shape that represents a communication to be presented to a user, and controls the LEE layer to emit light from the first portion of the LEE layer that is pressed against the deformable layer to illuminate the shape of the deformable layer.

Some embodiments include at least one computer readable storage medium comprising a set of instructions. which when executed by a computing device, cause the computing device to identify a communication that is to be presented to a user, control a first plurality of actuators to press a first portion of a LEE layer against a deformable layer to deform the deformable layer into a shape that represents the communication to be presented to the user, and control the LEE layer to emit light from the first portion of the LEE layer that is pressed against the deformable layer to illuminate the shape of the deformable layer Some embodiments include a method that includes identifying a communication that is to be presented to a user, controlling a first plurality of actuators to press a first portion of a LEE layer against a deformable layer to deform the deformable layer into a shape that represents the communication to be presented to the user, and controlling the LEE layer to emit light from the first portion of the LEE layer that is pressed against the deformable layer to illuminate the shape of the deformable layer.

BRIEF DESCRIPTION OF THE SEVERAL VIEWS OF THE DRAWINGS

The various advantages of the embodiments of the present disclosure will become apparent to one skilled in the art by reading the following specification and appended claims, and by referencing the following drawings, in which:

DETAILED DESCRIPTION

Embodiments as described herein relate to an apparatus, method and system to display a message (e.g., a three-dimensional message) on any type of surface. In detail, a surface (e.g., any type of flat or curve surface) of a vehicle may be deformed to display the message. For example, the surface may be a morphing material. An LEE layer may be disposed proximate and beneath the morphing material. An actuator layer is also positioned beneath the morphing material to press the LEE layer against the morphing material to deform the morphing material into the message. The LEE layer may also emit light at various colors and intensities to form the message. The message may be a three-dimensional (3D) message that has a gradual slope to surrounding portions of the dashboard. Thus, individual elements of the actuator layer and the LEE layer may rise and fall to generate messages in the surface. The LEE layer may emit light to illuminate the raised portions of the surface to enhance clarity, appearance and the impression of the message.

Figure 1A:
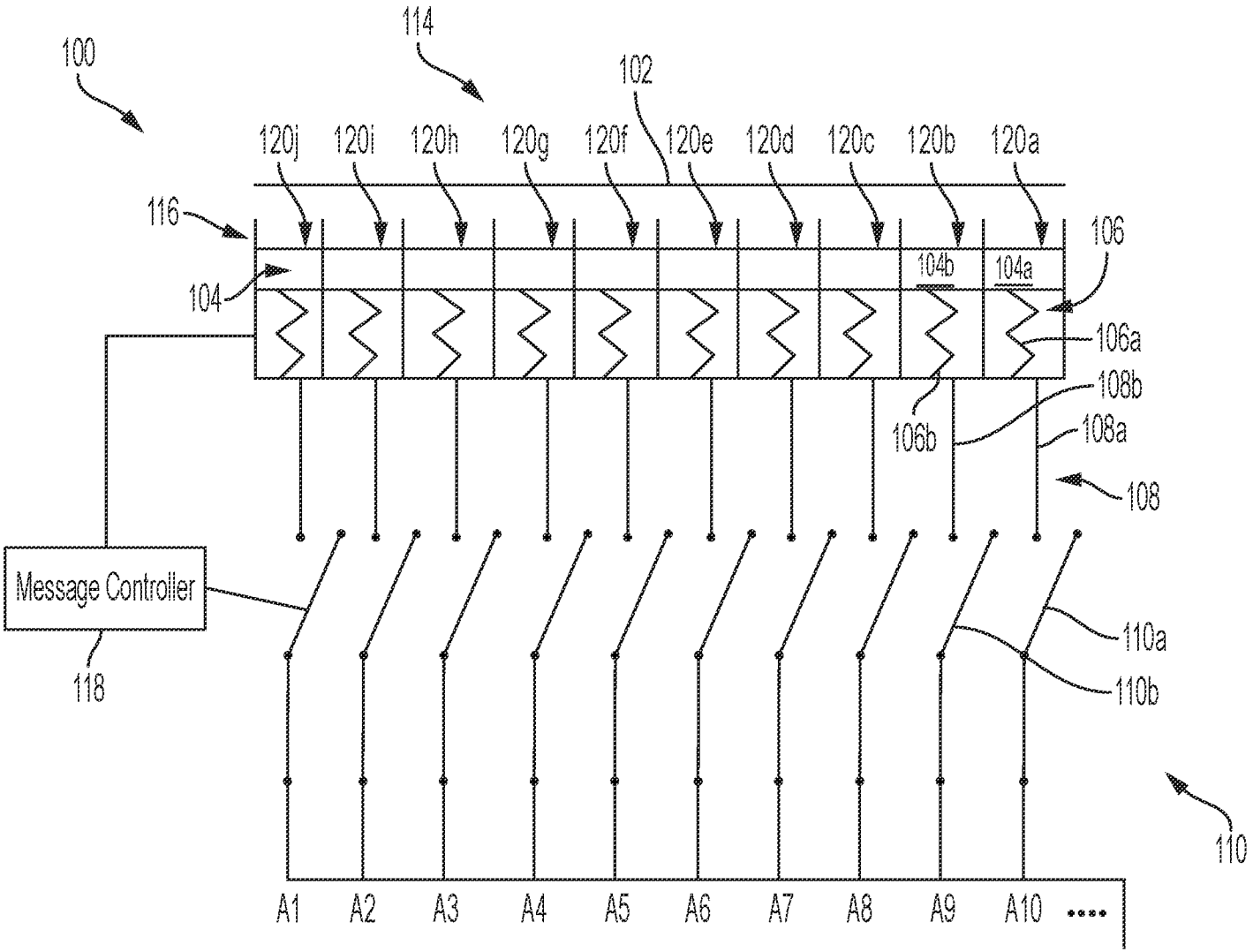
FIGS. 1A and 1B are diagrams of examples of apparatuses including a display system according to an embodiment.
Figure 1B:
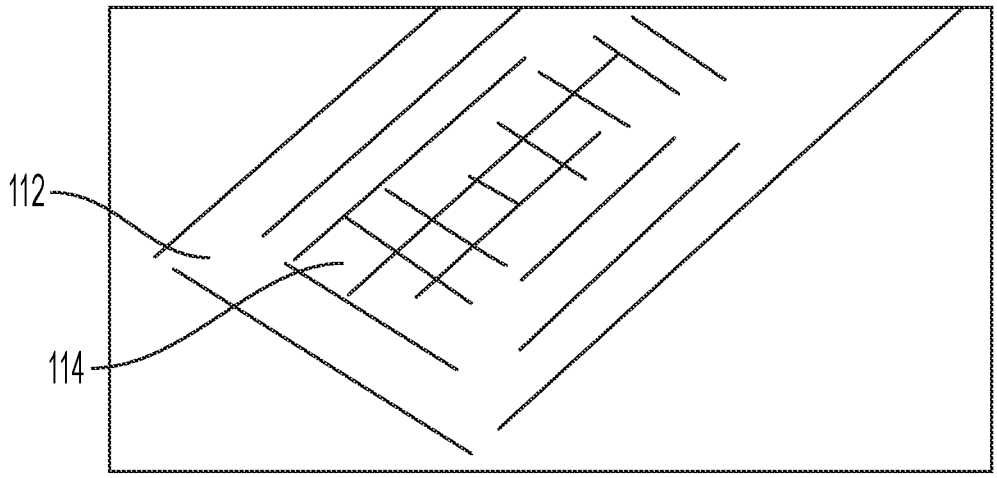

Turning now to FIG. 1A, an apparatus 100 including a display system 114 is illustrated. The display system 114 is disposed on a portion of a vehicle. For example, as illustrated in FIG. 1B, the display system 114 may be disposed on a dashboard 112 of the vehicle. The display system 114 may include a plurality of light emissive, message formation units 120*a*, 120*b*, 120*c*, 120*d*, 120*e*, 120*f*, 120*g*, 120*h*, 120*i*, 120*j*. The light emissive, message formation units 120*a*, 120*b*, 120*c*, 120*d*, 120*e*, 120*f*, 120*g*, 120*h*, 120*i*, 120*j* may be referred to as light emissive, message formation units 120*a*-120*j* for clarity. The light emissive, message formation units 120*a*-120*j* may each be similarly formed. For example, as will be discussed below, each of the light emissive, message formation units 120*a*-120*j* may include an LEE, light reduction leakage walls, an actuator, a conductor and a switch.

The display system 114 includes a deformable layer 102 (e.g., a surface). The deformable layer 102 may be comprised of a material that is deformable such that different portions of the deformable layer 102 are moveable relative to each other and are able to be displaced from a resting position (e.g., flat position). The deformable layer 102 may be an outer surface of the dashboard and visible to occupants of the vehicle. The light emissive, message formation units 120*a*-120*j* may be controlled to form messages (e.g., images, notifications, etc.) in the deformable layer 102 to communicate with occupants. That is, the light emissive, message formation units 120*a*-120*j* may form shapes that represent a communication to be presented to a user.

The display system 114 further includes a message controller 118 that is a computer and/or includes logic (e.g., configurable logic, fixed-functionality hardware logic, etc., or any combination thereof). In some examples, the message controller 118 includes at least one computer readable storage medium comprising a set of instructions, which when executed by a processor of the message controller 118, causes the message controller 118 to implement aspects described herein. The message controller 118 may control LEEs of an LEE layer 104 to emit light at various intensities and colors, and control an actuator layer 106 to selectively move the LEEs of the LEE layer 104.

As illustrated, the display system 114 further includes the LEE layer 104. The message controller 118 may control the LEE layer 104 to emit light at various colors and intensities. For example, the LEE layer 104 may include a series of LEDs that may be individually controlled to form messages (e.g., shapes and light that represents the message). The messages may be of any type, and may be symbols, words, letters, etc. For example, if the number "30" is to be formed, the message controller 118 may control LEDs in specific rows (as illustrated by A1-A10) and columns (unillustrated) to emit light and form the number "30," while others of the LEDs may be bypassed to avoid emitting light from the others of the LEDs to reduce obfuscation of the number "30."

As illustrated, the display system 114 further includes actuator layer 106 and switch logic 110 (e.g., transistors). The actuator layer 106 may include a plurality of actuators. The plurality of actuators (e.g., similarly shaped actuated cylinders with cylindrical enclosures) may initially be at a resting state. When electrical signals are applied to the actuators, the actuators may expand to displace the LEE layer 104 from a first state in which the LEE layer 104 is out of contact with the deformable surface 102, to a second state in which the LEE layer 104 is in contact with the deformable layer 102.

The message controller 118 may control the switch logic 110 to selectively transmit the electrical signals to the actuators of the actuator layer 106. For example, the switch logic 110 may be connected to an input voltage source. When switches are closed, voltage and current may be applied to the actuator layer 106 to expand the actuators. When the switches are open, the actuators of the actuator layer 106 are disconnected from the voltage and current, and do not expand. Thus, the switch logic 110 may control an application of an electrical signal that includes input voltage and/or input current to the actuator layer 106. That is, the switch logic 110 may include a plurality of switches that are individually controlled to selectively apply electrical signals to the actuators of the actuator layer 106 to expand the actuators.

For example, if the message controller 118 controlled the first switch 110*a* of the switch logic 110 to be in a closed state, an electrical signal may be conducted to a first actuator 106*a* of the actuator layer 106 to expand the first actuator 106*a*. The first actuator 106*a* may expand to displace the first LEE 104*a* and press the first LEE 104*a* against the deformable layer 102. Similarly, if the message controller 118 controlled a second switch 110*b* of the switch logic 110 to be in a closed position, an electrical signal may be conducted to a second actuator 106*b* of the actuator layer 106 to expand the second actuator 106*b*. The second actuator 106*b* may expand to displace a second LEE 104*b* of the LEE layer 104 and press the second LEE 104*b* against the deformable layer 102. Notably, one of the first and second switches 110*a*, 110*b* may in a closed state to conduct an electrical signal while the other of the first and second switches 110*a*, 110*b* may in an open state to not conduct an electrical signal such that only one of the first and second LEEs 104*a*, 104*b* is pressed against the deformable layer 102. For illustrative purposes, the first and second switches 110*a*, 110*b*, as well as all the switches of the switch logic 110, are shown as being opened, but it will be understood that the switches may be closed in which case the top portions of the first and second switches 110*a*, 110*b* would make direct contact with first and second conductors 108*a*, 108*b* respectively.

Thus, the message controller 118 may selectively control switches of the switch logic 110 to apply electrical signals to actuators of the actuator layer 106. That is, in some examples, the message controller 118 controls the switch logic 110 to selectively expand actuators of the actuator layer 106 to selectively press portions of the LEE layer 104 against the deformable layer 102 to deform the deformable layer 102.

As discussed above, the plurality of actuators of the actuator layer 106 may be disposed in rows (e.g., A1-A10) and columns (unillustrated) to correspond to the LEEs of the LEE layer 104. That is, each LEE may be moveable by one of the actuators. The message controller 118 controls the actuator layer 106 to selectively press portions of the LEE layer 104 against the deformable layer 102 to generate a 3D view of the message. That is, as the portions come into contact with the deformable layer 102, the deformable layer 102 is raised and the light from the portions shines through the deformable layer 102. Thus, the actuators of the actuator layer 106 may press the portions of the LEE layer 104 to generate a 3D message (i.e., the message may be a 3D message).

For example, if the number "30" is to be formed, the message controller 118 may close a first plurality of the switches of the switch logic 110 to expand actuators in the actuator layer 106 in specific rows and columns to move LEEs into contact with the deformable layer 102 to form a 3D representation of the number "30." Furthermore, the message controller 118 may open a second plurality of switches of the switch logic 110 so that others of the actuators do not have current applied thereto and thus do not expand. Thus, other LEE do not press against the deformable layer 102 and/or emit light so to not obscure the number "30." Thus, the message controller 118 may control a first plurality of actuators of the actuator layer 106 to press a first portion of the LEE layer 104 against the deformable layer 102 to deform the deformable layer 102 into a message (e.g., 3D message of the number 30).

In some examples, the message controller 118 may control a first plurality of actuators of the actuator layer 106 to press the first portion of the LEE layer 104 against the deformable layer 102 to displace the first portion by a first distance, and control the first plurality of actuators of the actuator layer 106 to press a second portion of the LEE layer 104 against the deformable layer 102 to displace the second portion by a second distance, where the second distance is less than the first distance. In some examples the message controller 118 may determine a slope associated with a 3D message that is to be presented to a user, and determine the first and second distances based on the slope. For example, suppose that the slope is to be a gradual slope (e.g., 0.5). The first distance and second distances may be set to achieve the slope. The slope may be a gradual slope to reduce structural damage from a sudden and abrupt positional change between the first and second portions (e.g., a large difference in height (or other dimension) between the first and second portions). That is, the preferred slope of the deformable layer 102 may define the first and second distances such that the deformable layer 102 has a shape that includes the preferred slope.

The message controller 118 may also control the LEE layer 104 to emit light from the first portion of the LEE layer 104 that is pressed against the deformable layer 102 to further augment the impression of the message. For example, the message controller 118 may further control the first portion of the LEE layer 104 to generate light at an intensity and with a color associated with 3D message. The second portion of the LEE layer 104 may also be controlled to emit light, where the light may be at a lower intensity and/or different color from the light emitted from the first portion of the LEE layer 104.

Some embodiments further include walls 116 that are disposed between the plurality of LEEs to reduce light leakage between the LEEs. In a resting state, the walls 116 are held as shown in FIG. 1A. As will be discussed below with respect to FIGS. 4A-4B below, when the LEEs of the LEE layer 104 are raised and emit light, the walls 116 may also be raised (via actuators) from the resting state to a raised state in which light leakage between the LEEs may be reduced. In the raised state, the walls 116 are proximate to the deformable layer 102. The walls 116 may be held stationary in the raised state while the LEEs push and contact the deformable layer 102 to move the deformable layer. Thus, the walls 116 and the LEEs may be raised to different positions and by different amounts.

Each of the light emissive, message formation units 120*a*-120*j* may be similarly formed. As an example, a first light emissive, message formation unit 120*a* includes a first LEE 104*a* of the LEE layer 104, a first actuator 106*a*, two walls of the walls 116, a first conductor 108*a* of the conductors 108, and the first switch 110*a*. The message controller 118 may individually control the first LEE 104*a* to emit light. The message controller 118 may also individually control the first switch 110*a* to close and conduct an electrical signal to the first conductor 108*a* and the first actuator 106*a* to expand the first actuator 106*a* so as to press the LEE 104*a* against the deformable layer 102.

Furthermore, a second light emissive, message formation unit 120*a* includes the second LEE 104*b* of the LEE layer 104, the second actuator 106*b*, two walls of the walls 116, the second conductor 108*b* of the conductors 108, and the second switch 110*b*. The message controller 118 may individually control the second LEE 104*b* to emit light. The message controller 118 may also individually control the second switch 110*b* to close and conduct an electrical signal to the second conductor 108*b* and the second actuator 106*b* to expand the second actuator 106*b* so as to press the LEE 104*b* against the deformable layer 102.

Each of the remaining light emissive, message formation units 120*c*-120*j* is similarly formed to the first light emissive, message formation unit 120*a* and the second light emissive, message formation unit 120*b* described above. The descriptions of the light emissive, message formation units 120*c*-120*j* are not described in detail for brevity.

Thus, embodiments may enable any surface within a vehicle to display messages, such as vehicle operation, road information, navigation instructions, and the like. These surfaces may be flat and/or curved, or otherwise not have the messages visible when no message is being displayed.

Furthermore, areas of the vehicle, such as the dashboard, may be made of morphing material that is stretchable to form the deformable layer 102. Beneath the deformable layer 102 is an array of similarly shaped actuated cylinders constituted by the actuators of the actuator layer 106 that rise and fall to form messages on the dash. The LEE layer 104 (which may be an LED layer) is disposed between the deformable layer 102 and the actuator layer 106 defined by the actuated cylinders. The switch logic 110 may individually address each actuated cylinder of the actuation layer 106 based on commands from the message controller 118. When an actuated cylinder of the actuator layer 106 is lifted the actuated cylinder presses the LEE layer 104 (e.g., a flexible LED layer) against a bottom surface of the deformable layer 102 such that the morphing material of the deformable layer 102 is raised and the light from the LEE layer 104 shines through the morphing material.

In some examples the display system 114 may be located on the exterior of the vehicle. For example, the display system 114 may supplement and/or augment a typical turn-indicator. For example, the display system 114 may provide accurate details about the navigation of a vehicle that are more granular than a conventional turn-indicator. That is, the display system 114 may receive navigation directions from a navigation system associated with the vehicle, and generate messages of the navigation directions on the deformable layer 102 that notify other motorists of future navigation actions (e.g., this vehicle will take a right turn in 100 feet on Independent Avenue). In some embodiments, the applications of the display system 114 may include messages regarding vehicle status and health and instructions for navigation (e.g., turn-by-turn) for example. The LEE layer 104 may comprise various types of elements (e.g., filament lamps, discharge lamps, condensed fluorescent light bulbs, light-emitting diodes (LEDs), etc.).

It is also worthwhile to note that the direction of movement of the LEEs of the LEE layer 104 is disclosed as being vertical. It will be understood that the display system 114 may be oriented in any fashion such that the LEEs move in any direction (e.g., vertical direction, horizontal direction, skewed direction, etc.)

Figure 2A:
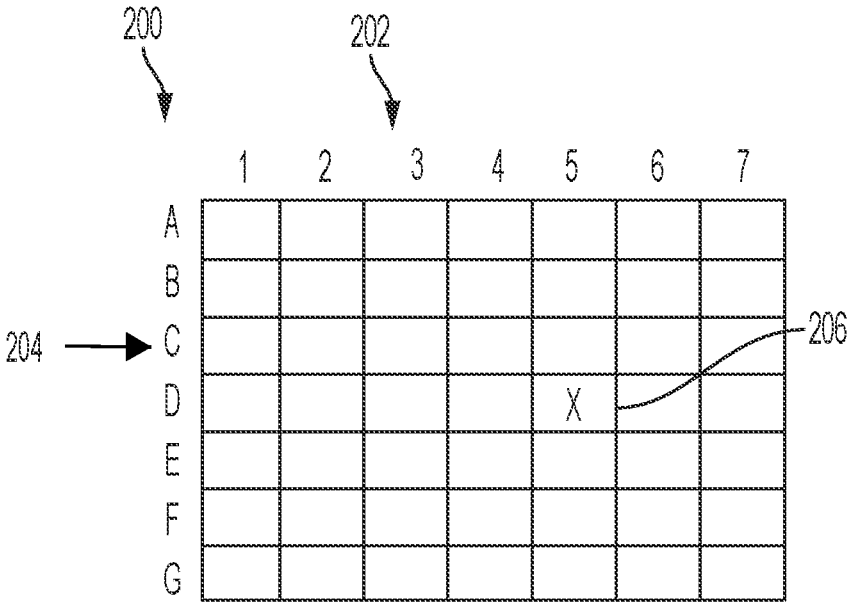
FIG. 2A is a diagram of an example of an addressing system according to an embodiment.

FIG. 2A illustrates an addressing system 200 to control a plurality of light emissive, message formation units (e.g., actuators and LEEs) below the surface of a deformable layer. The addressing system 200 is readily combinable with the display system 114 (FIG. 1). For example, the message controller 118 may control the plurality of light emissive, message formation units 120*a*-120*j* in a similar manner as discussed with respect to addressing system 200. In the illustrated embodiment rows 204 are identified by letters A through G and columns 202 are identified by numbers 1 through 7. A different light emissive, message formation unit may be disposed at each column and row intersection. Thus, the light emissive, message formation units may be individually addressed and controlled through electrical signals applied to specific rows and columns. For example, a message controller may address each respective light emissive, message formation unit by selecting a row (e.g., D) and column (e.g., 5), closing a switch located at the row and the column and thereby expanding an actuator. Moreover, the message controller may emit light from an LEE associated with the row and column through controlling an electrical signal to the row and column to the LEE.

For example, suppose that a first light emissive, message formation unit 206 is to emit light and also be raised to form a 3D message. The message controller may address electrical signals to row D, column 5 to close the switch of the first light emissive, message formation unit 206 and thereby expand an actuator of the first light emissive, message formation unit 206 and press an LEE of the first light emissive, message formation unit 206 against the deformable layer. The message controller may further address electrical signals to row D, column 5 to cause the first light emissive, message formation unit 206 to emit light. Other light emissive, message formation units may be similarly controlled based on addresses of the light emissive, message formation units.

Figure 2B:
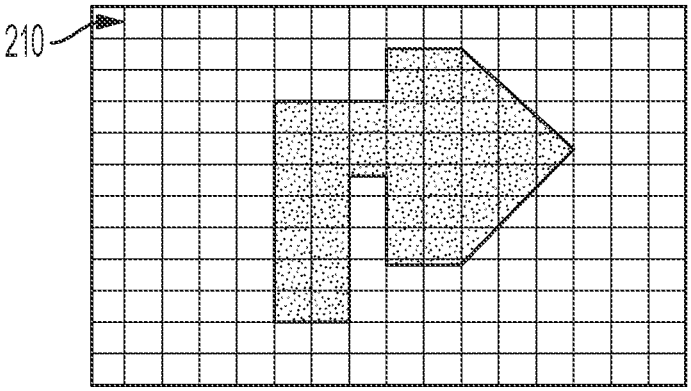
FIG. 2B is an example of message formation according to an embodiment.

FIG. 2B illustrates a message formation example 210 in which the addressing system 200 (FIG. 2A) is incorporated. The message formation example 210 may be formed by the display system 114 (FIG. 1) for example. That is, a message controller may address individual light emissive, message formation units with an addressing system 200 (FIG. 2A) to form a desired message, which in this case is an arrow. In this example, approximately thirty of the light emissive, message formation units are controlled to form the arrow and deformed for the surface layer. Other examples may include a message such an icon, a graphic, or text.

Figure 3:
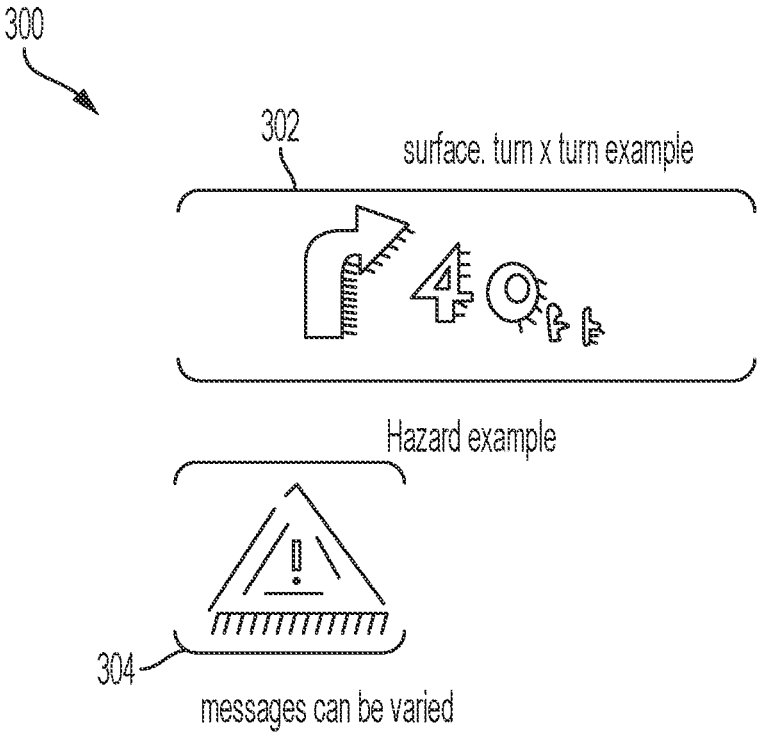
FIG. 3 is an example of message implementation according to an embodiment.

FIG. 3 illustrates an example of a message implementations 300. Message implementations 300 are readily combinable with the display system 114 (FIG. 1), addressing system 200 (FIG. 2A) and message formation example 210 (FIG. 2B). A turn-by-turn navigation example 302 is illustrated to provide directions to a user. A hazard example 304 may also be displayed. The individual actuated cylinders and LEE layer associated therewith may rise to form the text or icon graphic that is intended to be displayed such as the turn-by-turn navigation example 302 or the hazard example 304. Accordingly, messages rise from the surface defined by the deformable material.

Figure 4A:
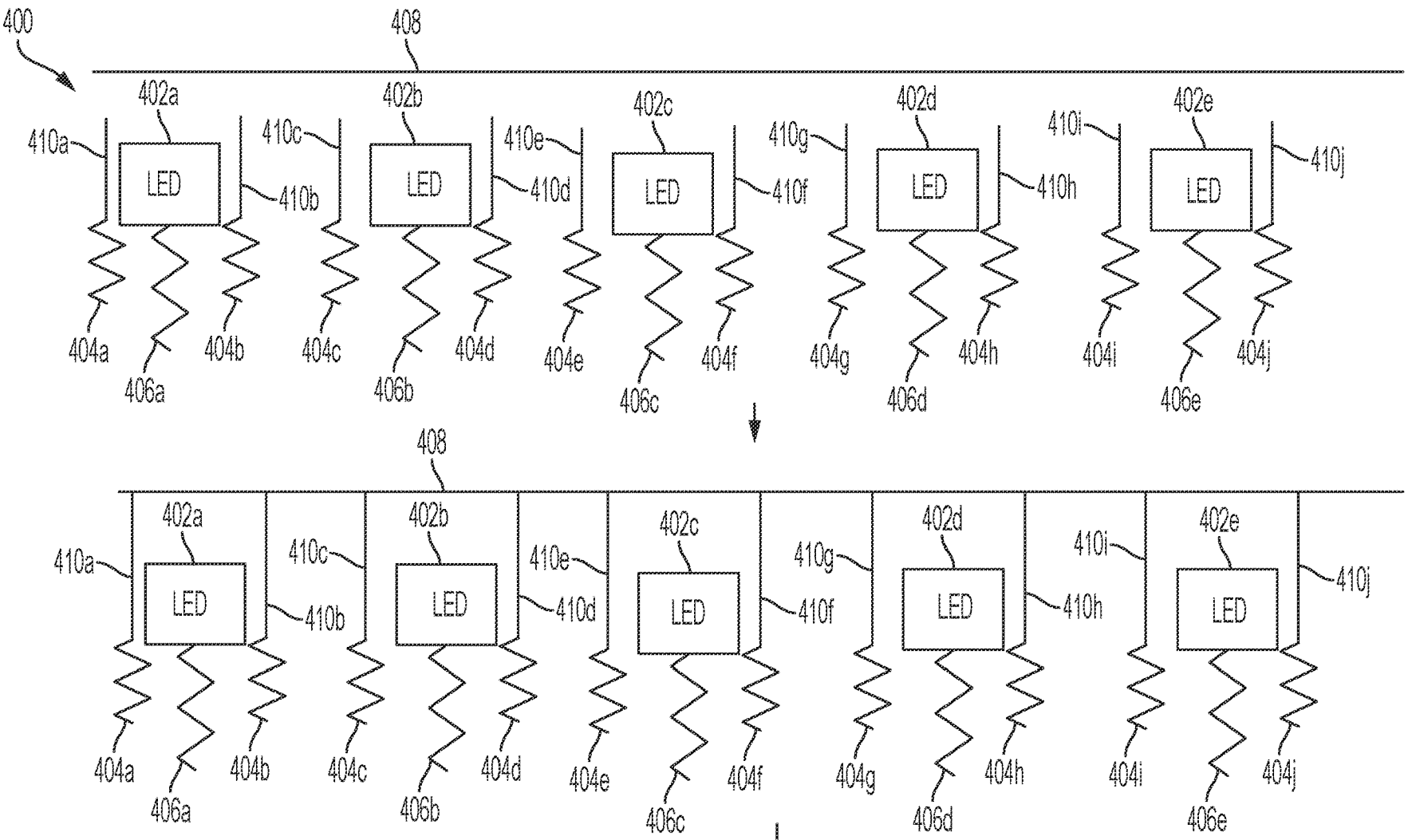
FIGS. 4A and 4B are examples of processes to generate a three-dimensional message according to an embodiment.

FIG. 4A illustrates a process 400 to generate a 3D message with light leakage protection. The process 400 may be readily combinable with the display system 114 (FIG. 1), addressing system 200 (FIG. 2A), message formation example 210 (FIG. 2B) and/or message implementations 300 (FIG. 3). A plurality of LEDs 402*a*-402*e* (which may be an LEE layer) are disposed on a first plurality of actuators 406*a*-406*e*. Walls 410*a*-404*j* surround the LEDs 402*a*-402*e* to reduce light leakage into unwanted areas. The walls 410*a*-404*j* are disposed on a second plurality of actuators 404*a*-404*j*. As will be explained below, as the LEDs 402*a*-402*e* are raised, the walls 410*a*-410*j* may also be raised to reduce light leakage. Initially, top surfaces of the LEDs 402*a*-402*e* are disposed at a same level or below top of the walls 410*a*-404*j*. Initially, the LEDs 402*a*-402*e* may be disposed a same distance from a deformable surface 408.

Thereafter, a message controller may apply electrical signals to the first plurality of actuators 406*a*-406*e* and the second plurality of actuators 404*a*-404*j* to expand the first plurality of actuators 406*a*-406*e* and the second plurality of actuators 404*a*-404*j*. The expansion of the first plurality of actuators 406*a*-406*e* causes the LEDs 402*a*-402*e* to move towards the deformable surface 408 and reduce the distance therebetween. The LEDs 402*a*-402*e* may be emitting light.

Similarly the expansion of the second plurality of actuators 404*a*-404*j* causes the walls 410*a*-404*j* to move towards the deformable surface 408 and reduce the distance therebetween. Thus, at this point, the walls 410*a*-410*j* may move concurrently with the LEDs 402*a*-402*e* to reduce light leakage and contact the deformable surface 408 prior to the LEDs 402*a*-402*e* contacting the deformable surface 408. For example, the first plurality of actuators 406*a*-406*e* and the second plurality of actuators 404*a*-404*j* may receive a same current. The first plurality of actuators 406*a*-406*e* may be larger than the second plurality of actuators 404*a*-404*j* such that the second plurality of actuators 404*a*-404*j* expand at a greater rate based on the current, but to a smaller degree than the first plurality of actuators 406*a*-406*e*. The top surfaces of the LEDs 402*a*-402*e* are disposed below top of the walls 410*a*-404*j* to reduce light leakage.

Figure 4B:
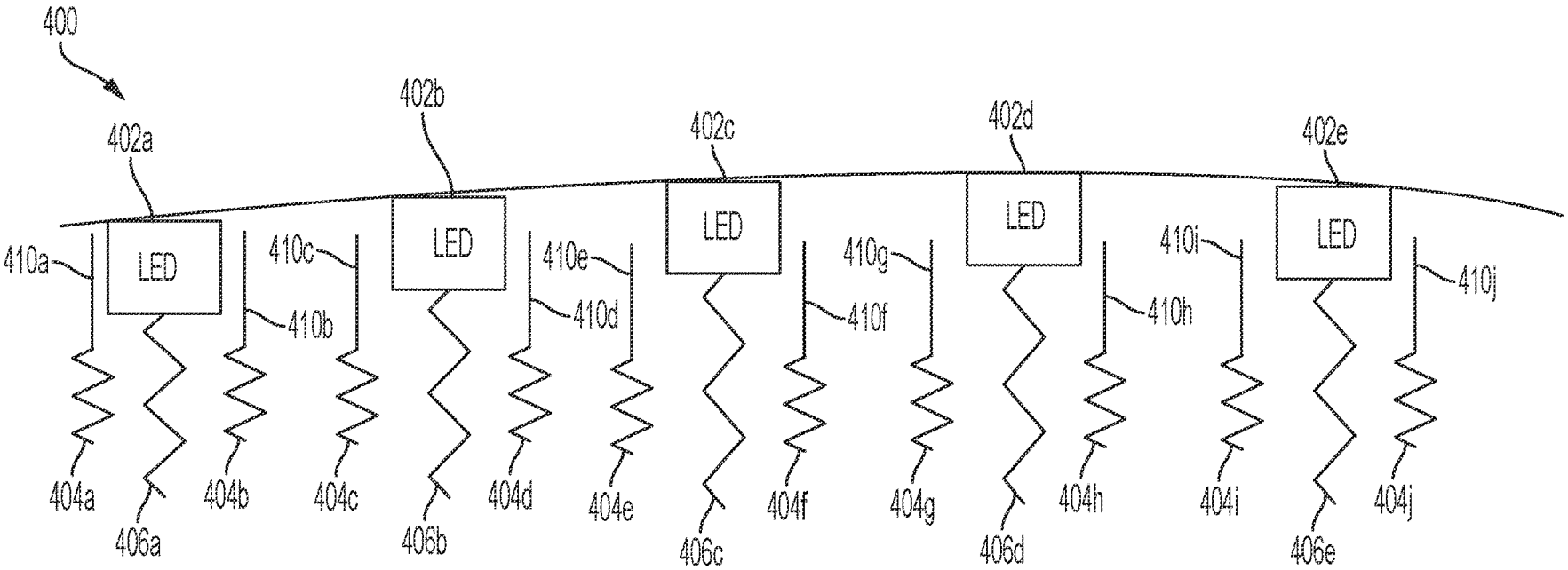

As illustrated in FIG. 4B, the expansion of the first plurality of actuators 406*a*-406*e* causes the LEDs 402*a*-402*e* to contact deformable surface 408 to deform the deformable surface 408 and move above the walls 410*a*-404*j*. Notably, the LEDs 402*a*-402*e* push the deformable surface 408 from a flat shape to a curve shape to deform the deformable surface 408. Further, the second plurality of actuators 404*a*-404*j* are at a maximum expansion and may no longer expand while the first plurality of actuators 406*a*-406*e* may continue to expand. Thus, the walls 410*a*-404*j* may be maintained in a raised state to avoid direct contact between the walls 410*a*-410*j* and the deformable surface 408. As this point the first plurality of actuators 406*a*-406*e* may continue to expand to deform the deformable surface 408 while the expansion of the second plurality of actuators 404*a*-404*j* ceases.

Figure 5:
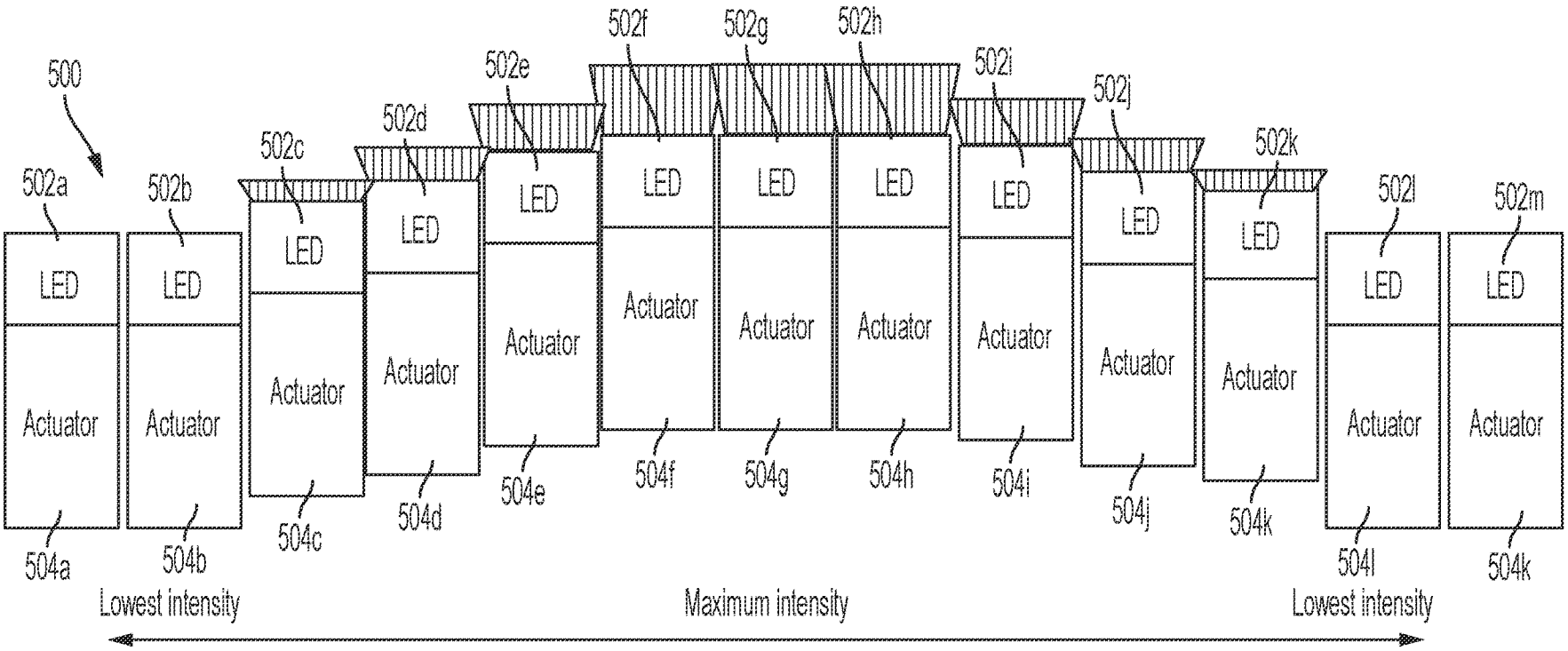
FIG. 5 is a diagram of an example of a display system according to an embodiment.

FIG. 5 show a display system 500 that includes a plurality of LEDs 502*a*-502*m* and actuators 504*a*-504*k* to move the plurality of LEDs 502*a*-502*m*. The display system 500 may be readily combinable with the display system 114 (FIG. 1), addressing system 200 (FIG. 2A), message formation example 210 (FIG. 2B), message implementations 300 (FIG. 3) and/or process 400 (FIG. 4).

As illustrated in FIG. 5, LEDs 502*a*, 502*b*, 502*c*, 502*d*, 502*e*, 502*f*, 502*g*, 502*h*, 502*i*, 502*j*, 502*k*, 502*l*, 502*m* are arranged at different heights. The centermost LEDs 502*f*, 502*g*, 502*h* have the greatest light intensity. The LEDs 502*i*, 502*j*, 502*k* may have decreasing light intensity as distance increases from the centermost LEDs 502*f*, 502*g*, 502*h*. Similarly, the LEDs 502*e*, 502*d*, 502*c* have decreasing light intensity as distance from the centermost LEDs 502*f*, 502*g*, 502*h* increases. The position of the LEDs 502*a*, 502*b*, 502*c*, 502*d*, 502*e*, 502*f*, 502*g*, 502*h*, 502*i*, 502*j*, 502*k*, 502*l*, 502*m* may correspond to light intensity. For example, the centermost LEDs 502*f*, 502*g*, 502*h* are displaced to a greatest extent from a resting position, and therefore have the greatest intensity. The LEDs 502*a*, 502*b*, 502*l*, 502*m* are not displaced from the resting position and have no light emitted therefrom. The other LEDs 502*c*, 502*d*, 502*e*, 502*i*, 502*j*, 502*k* have intensities that correspond to displacement from the resting position.

Figure 6:
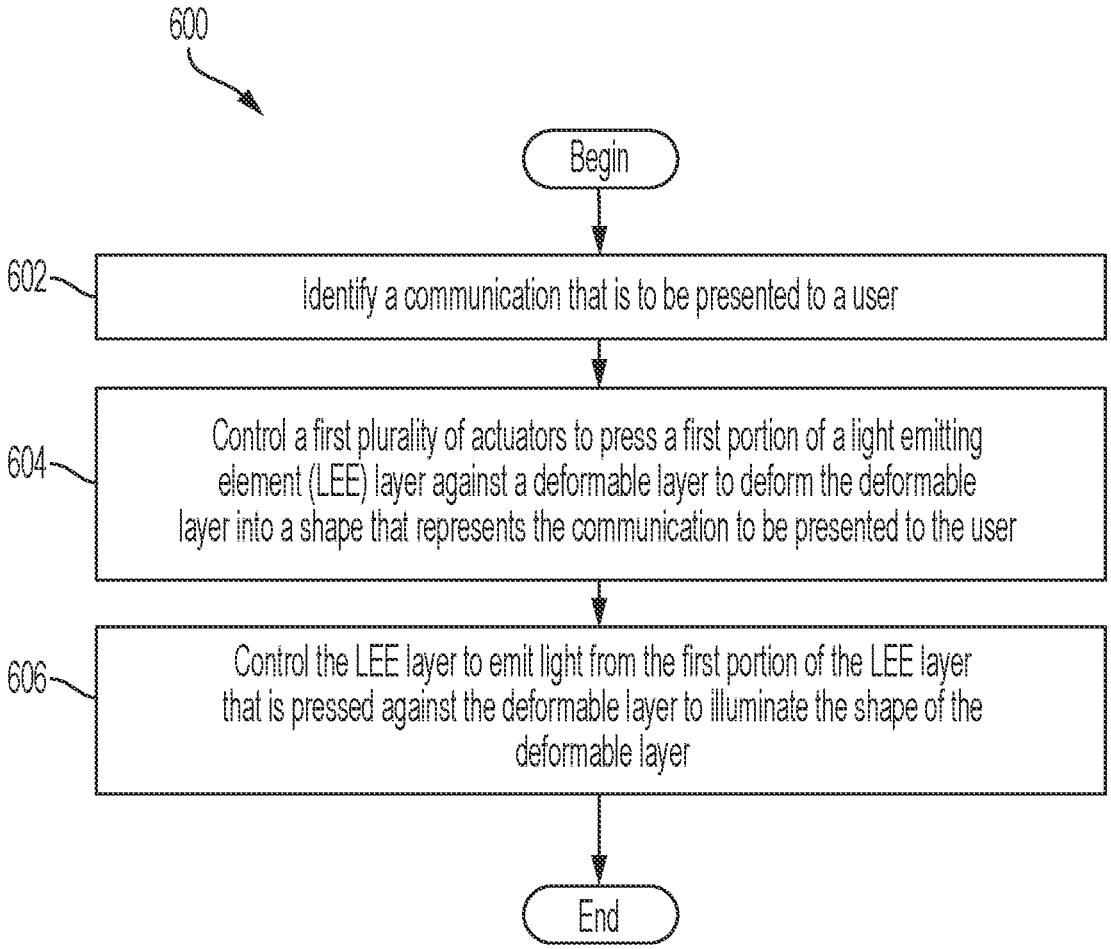
FIG. 6 is a flowchart of a method of controlling a display system according to an embodiment.

FIG. 6 shows a method 600 of controlling a display system. The method 600 may generally be implemented in with the display system 114 (FIG. 1), addressing system 200 (FIG. 2A), message formation example 210 (FIG. 2B), message implementations 300 (FIG. 3), process 400 (FIG. 4) and/or display system 500 (FIG. 5). In an embodiment, the method 600 is implemented in logic instructions (e.g., software), circuitry, configurable logic, fixed-functionality hardware logic, etc., or any combination thereof.

Illustrated processing block 602 includes identifying a communication that is to be presented to a user. Illustrated processing block 604 controls a first plurality of actuators to press a first portion of a LEE layer against a deformable layer to deform the deformable layer into a shape that represents the communication to be presented to the user. Illustrated processing block 606 controls the LEE layer to emit light from the first portion of the LEE layer that is pressed against the deformable layer to illuminate the shape of the deformable layer. In some examples, the shape is a 3D representation of the communication. In some examples, the method 600 comprises controlling the first portion of the LEE layer to generate the light at an intensity associated with the 3D representation and color associated with the 3D representation. In some examples, the method 600 includes controlling the first plurality of actuators to press the first portion of the LEE layer against the deformable layer to displace a first part of the deformable layer by a first distance, and controlling the first plurality of actuators to press a second portion of the LEE layer against the deformable layer to displace a second part of the deformable layer by a second distance, where the second distance is less than the first distance.

In some examples, the method 600 includes determining a slope associated with a 3D message that is to be presented to a user, and determining the first and second distances based on the slope. In some examples, the LEE layer includes a plurality of LEDs and the method 600 includes controlling a plurality of walls that are disposed between the plurality of LEDs to reduce light leakage, and moving a second plurality of actuators to move the walls in correspondence with the plurality of LEDs. In some examples the method 600 controls the first and second plurality of actuators to simultaneously move the plurality of walls from a resting state to a raised state, and while a first group of LEDs of the plurality of LEDs towards the deformable layer, and controls the second plurality of actuators to maintain the plurality of walls in the raised state while a first group of LEDs of the plurality of LEDs, that are associated with the first portion of the LEE layer, continue to move towards the deformable layer.

Figure 7:
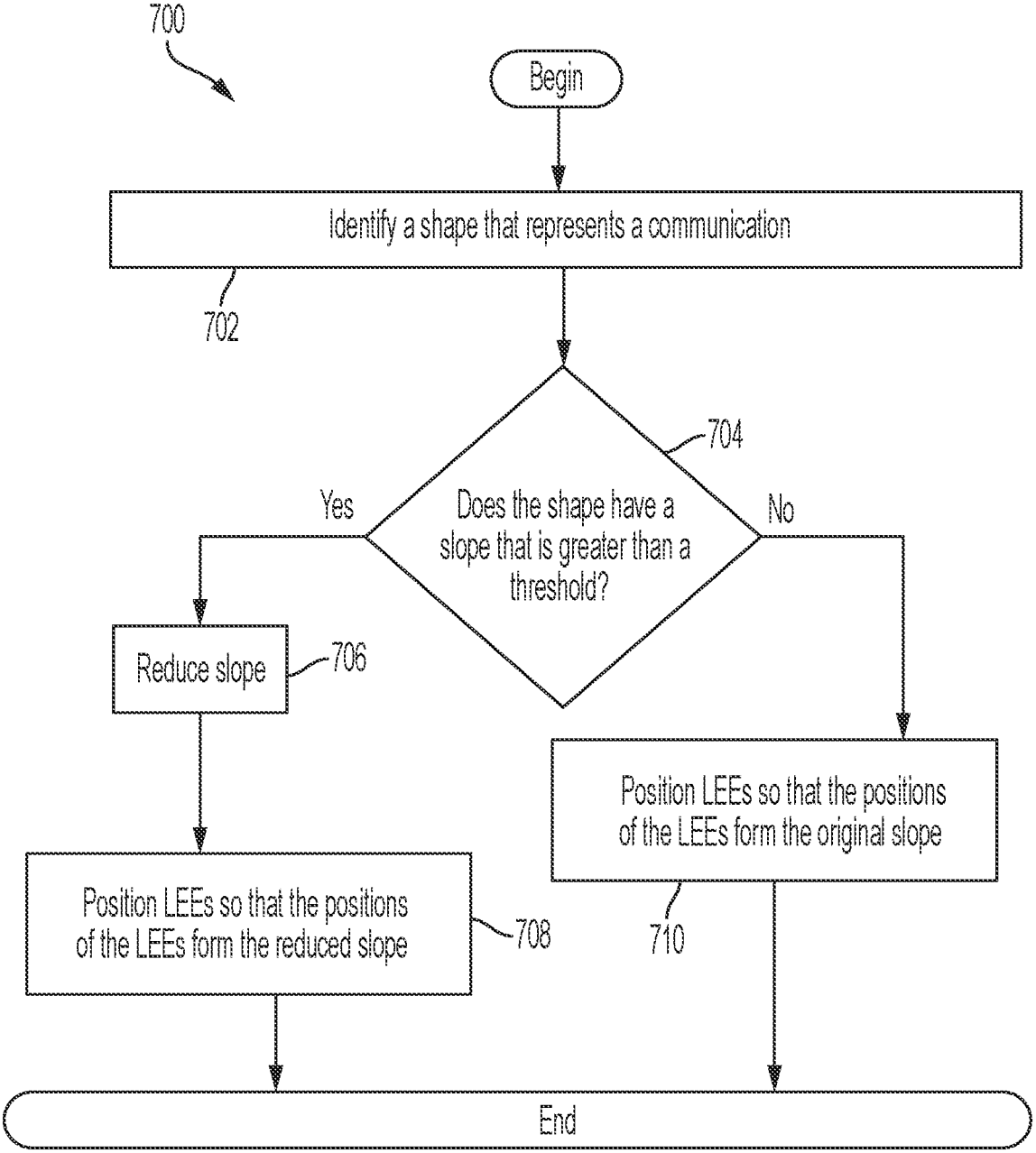
FIG. 7 is a flowchart of a method of adjusting a slope of a shape of a communication according to an embodiment.

FIG. 7 shows a method 700 of adjusting a slope of a shape of a communication. The method 700 may generally be implemented in conjunction with the display system 114 (FIG. 1), addressing system 200 (FIG. 2A), message formation example 210 (FIG. 2B), message implementations 300 (FIG. 3), process 400 (FIG. 4), display system 500 (FIG. 5) and/or method 600 (FIG. 6). In an embodiment, the method 600 is implemented in logic instructions (e.g., software), configurable logic, fixed-functionality hardware logic, etc., or any combination thereof.

Illustrated processing block 702 identifies a shape that represents a communication. Illustrated processing block 704 determines if the shape has a slope that is greater than a threshold. The threshold may correspond to a desired maximum slope and correspond to a maximum slope of a deformable layer without damaging the deformable layer. Exceeding the maximum slope may damage the deformable layer for example. If so, illustrated processing block 706 reduces the slope, and illustrated processing block 708 positions the LEEs so that the positions of the LEEs form the reduced slope in the deformable layer. If the shape does not have a slope that is greater than the threshold, illustrated processing block 710 positions the LEEs so that the positions of the LEEs form the original slope (i.e., the unaltered slope) in the deformable slope.

Figure 8:
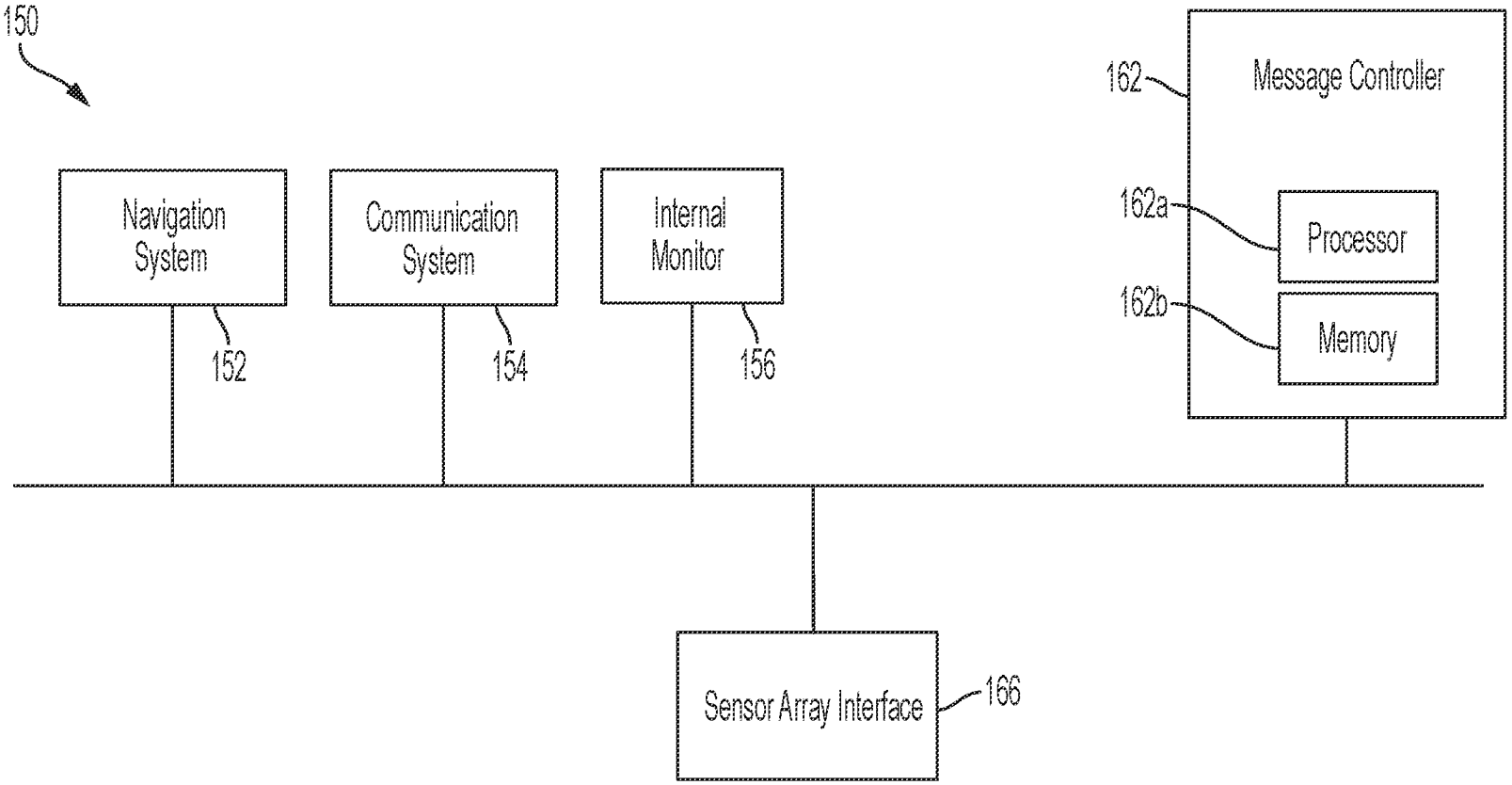
FIG. 8 is a block diagram of an example of a vehicle display system according to an embodiment.

FIG. 8 shows a more detailed example of a vehicle display system 150. The illustrated vehicle display system 150 may be readily substituted for be implemented in conjunction with the display system 114 (FIG. 1), addressing system 200 (FIG. 2A), message formation example 210 (FIG. 2B), message implementations 300 (FIG. 3), process 400 (FIG. 4), display system 500 (FIG. 5), method 600 (FIG. 6) and/or method 700 (FIG. 7).

In the illustrated example, the vehicle display system 150 may include a navigation system 152, a communication system 154, an internal monitor 156 and a sensor array interface 166 and message controller 162 that are different systems of the vehicle. The sensor array interface 166 may interface with a plurality of sensors, for example a global positioning system sensor, proximity sensor, message sensor, audio sensor, impact sensor, deceleration sensor, acceleration sensor to obtain sensor data. The sensor array interface 166 may interface with any type of sensor suitable for operations as described herein.

The message controller 162 may receive data from the sensor array interface 166, the navigation system 152, the communication system 154 and the internal monitor 156. The navigation system 152 may provide navigation directions to the message controller 162, which may present communications to a user providing the navigation directions. The communication system 154 may provide external communications (e.g., text messages from friends received via a transmitter) to the message controller 162, which may present the communications to the user to provide the messages. The internal monitor 156 may provide internal vehicle notifications (e.g., miles per gallon, remaining fuel, collision aversion notifications) to the message controller 162, which may present the notifications to the user providing the messages. The sensor array interface 166 may provide internal vehicle measurements (e.g., low air pressure, temperature, etc.) to the message controller 162, which may present the measurements to the user providing the messages.

The message controller 162 may include a processor 162*a* (e.g., embedded controller, central processing unit/CPU) and a memory 162*b* (e.g., non-volatile memory/NVM and/or volatile memory). The memory 162*b* contains a set of instructions, which when executed by the processor 162*a*, cause the message controller 162 to control a display system (e.g., actuators, LEEs, etc.) described herein based on the data from the sensor array interface 166, navigation system 152, communication system 154 and internal monitor 156.

The above described methods and systems may be readily combined together if desired. The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

Those skilled in the art will appreciate from the foregoing description that the broad techniques of the embodiments of the present disclosure can be implemented in a variety of forms. Therefore, while the embodiments of this disclosure have been described in connection with particular examples thereof, the true scope of the embodiments of the disclosure should not be so limited since other modifications will become apparent to the skilled practitioner upon a study of the drawings, specification, and following claims.

We claim:

1. A display system for a vehicle, the display system comprising:

a deformable layer that is configured to deform;

a light emitting element (LEE) layer;

a first plurality of actuators that are configured to press the LEE layer against the deformable layer to deform the deformable layer; and a message controller that includes logic to:

control the first plurality of actuators to press a first portion of the LEE layer against the deformable layer to deform the deformable layer into a shape that represents a communication to be presented to a user; and control the LEE layer to emit light from the first portion of the LEE layer that is pressed against the deformable layer to illuminate the shape of the deformable layer, wherein at least one of the plurality of actuators presses the first portion of the LEE layer against the deformable layer such that the first portion of the LEE layer emits light through the deformable layer.

2. The display system of claim 1, wherein the shape is a 3D representation of the communication, and wherein the logic is to control the first portion of the LEE layer to generate the light at an intensity associated with the 3D representation and color associated with the 3D representation.

3. The display system of claim 1, wherein the logic of the message controller is to:

control the first plurality of actuators to press the first portion of the LEE layer against the deformable layer to displace a first part of the deformable layer by a first distance;

control the first plurality of actuators to press a second portion of the LEE layer against the deformable layer to displace a second part of the deformable layer by a second distance, wherein the second distance is less than the first distance.

4. The display system of claim 3, wherein the logic of the message controller is to:

determine a slope associated with a 3D message that is to be presented to a user; and determine the first and second distances based on the slope.

5. The display system of claim 1, wherein the LEE layer includes a plurality of light-emitting diodes (LEDs), the display system further comprises:

a plurality of walls that are disposed between the plurality of LEDs to reduce light leakage; and a second plurality of actuators to move the walls in correspondence with the plurality of LEDs.

6. The display system of claim 5, wherein the logic of the message controller is to:

control the second plurality of actuators to move the plurality of walls from a resting state to a raised state; and control the second plurality of actuators to maintain the plurality of walls in the raised state while a first group of LEDs of the plurality of LEDs, that are associated with the first portion of the LEE layer, move the deformable layer.

7. The display system of claim 6, wherein the logic of the message controller is to:

control the first and second plurality of actuators to simultaneously move the plurality of walls to the raised state and the first group of LEDs towards the deformable layer.

8. At least one non-transitory computer readable storage medium comprising a set of instructions, which when executed by a computing device, cause the computing device to:

identify a communication that is to be presented to a user;

control a first plurality of actuators to press a first portion of a light emitting element (LEE) layer against a deformable layer to deform the deformable layer into a shape that represents the communication to be presented to the user; and control the LEE layer to emit light from the first portion of the LEE layer that is pressed against the deformable layer to illuminate the shape of the deformable layer, wherein at least one of the plurality of actuators presses the first portion of the LEE layer against the deformable layer such that the first portion of the LEE layer emits light through the deformable layer.

9. The at least one non-transitory computer readable storage medium of claim 8, wherein the shape is a 3D representation of the communication, and further wherein the instructions, when executed, cause the computing device to control the first portion of the LEE layer to generate the light at an intensity associated with the 3D representation and color associated with the 3D representation.

10. The at least one non-transitory computer readable storage medium of claim 8, wherein the instructions, when executed, cause the computing device to control the first plurality of actuators to press the first portion of the LEE layer against the deformable layer to displace a first part of the deformable layer by a first distance; and control the first plurality of actuators to press a second portion of the LEE layer against the deformable layer to displace a second part of the deformable layer by a second distance, wherein the second distance is less than the first distance.

11. The at least one non-transitory computer readable storage medium of claim 10, wherein the instructions, when executed, cause the computing device to:

determine a slope associated with a 3D message that is to be presented to a user; and determine the first and second distances based on the slope.

12. The at least one non-transitory computer readable storage medium of claim 8, wherein the LEE layer includes a plurality of light-emitting diodes (LEDs); and wherein the instructions, when executed, cause the computing device to:

control a plurality of walls that are disposed between the plurality of LEDs to reduce light leakage; and move a second plurality of actuators to move the walls in correspondence with the plurality of LEDs.

13. The at least one non-transitory computer readable storage medium of claim 12, wherein the instructions, when executed, cause the computing device to:

control the second plurality of actuators to move the plurality of walls from a resting state to a raised state; and control the second plurality of actuators to maintain the plurality of walls in the raised state while a first group of LEDs of the plurality of LEDs, that are associated with the first portion of the LEE layer, move the deformable layer.

14. The at least one non-transitory computer readable storage medium of claim 13, wherein the instructions, when executed, cause the computing device to:

control the first and second plurality of actuators to simultaneously move the plurality of walls to the raised state and the first group of LEDs towards the deformable layer.

15. A method comprising:

identifying a communication that is to be presented to a user;

controlling a first plurality of actuators to press a first portion of a light emitting element (LEE) layer against a deformable layer to deform the deformable layer into a shape that represents the communication to be presented to the user; and controlling the LEE layer to emit light from the first portion of the LEE layer that is pressed against the deformable layer to illuminate the shape of the deformable layer, wherein at least one of the plurality of actuators presses the first portion of the LEE layer against the deformable layer such that the first portion of the LEE layer emits light through the deformable layer.

16. The method of claim 15, wherein the shape is a 3D representation of the communication, and further wherein the method comprises controlling the first portion of the LEE layer to generate the light at an intensity associated with the 3D representation and color associated with the 3D representation.

17. The method of claim 15, further comprising:

controlling the first plurality of actuators to press the first portion of the LEE layer against the deformable layer to displace a first part of the deformable layer by a first distance; and controlling the first plurality of actuators to press a second portion of the LEE layer against the deformable layer to displace a second part of the deformable layer by a second distance, wherein the second distance is less than the first distance.

18. The method of claim 17, further comprising:

determining a slope associated with a 3D message that is to be presented to a user; and determining the first and second distances based on the slope.

19. The method of claim 15, wherein the LEE layer includes a plurality of light-emitting diodes (LEDs); and further comprising:

controlling a plurality of walls that are disposed between the plurality of LEDs to reduce light leakage; and moving a second plurality of actuators to move the walls in correspondence with the plurality of LEDs.

20. The method of claim 19, further comprising:

control the first and second plurality of actuators to simultaneously move the plurality of walls from a resting state to a raised state, and while a first group of LEDs of the plurality of LEDs towards the deformable layer; and controlling the second plurality of actuators to maintain the plurality of walls in the raised state while a first group of LEDs of the plurality of LEDs, that are associated with the first portion of the LEE layer, move the deformable layer.

* * * * *